US006854273B1

(12) United States Patent
Lasley et al.

(10) Patent No.: US 6,854,273 B1
(45) Date of Patent: Feb. 15, 2005

(54) APPARATUS AND METHOD FOR STEAM ENGINE AND THERMIONIC EMISSION BASED POWER GENERATION SYSTEM

(75) Inventors: Andrew J. Lasley, Noblesville, IN (US); Gerald Thomas Fattic, Fishers, IN (US); Kaushik Rajashekara, Carmel, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/754,843

(22) Filed: Jan. 9, 2004

Related U.S. Application Data

(60) Provisional application No. 60/512,828, filed on Oct. 20, 2003.

(51) Int. Cl.[7] ..... F01K 13/02
(52) U.S. Cl. ..... 60/646; 60/679
(58) Field of Search ..... 60/646, 670, 679, 60/680, 685

(56) References Cited

U.S. PATENT DOCUMENTS 3,846,637 A * 11/1974 Gettinger ..... 422/186
3,975,913 A * 8/1976 Erickson ..... 60/645
4,280,328 A * 7/1981 Falconer ..... 60/641.12
4,428,190 A * 1/1984 Bronicki ..... 60/655
4,478,039 A * 10/1984 Horgan ..... 60/781
5,312,521 A 5/1994 Fraas et al. ..... 136/253
5,593,509 A 1/1997 Zuppero et al. ..... 136/253
5,845,496 A * 12/1998 Bachmann ..... 60/646
5,942,047 A 8/1999 Fraas et al. ..... 136/253
6,192,687 B1 * 2/2001 Pinkerton et al. ..... 60/646
6,230,494 B1 5/2001 Botti et al. ..... 60/649
6,321,145 B1 11/2001 Rajashekara ..... 701/22
6,396,191 B1 5/2002 Hagelstein et al. ..... 310/306
6,407,477 B1 6/2002 King et al. ..... 310/306
6,423,896 B1 7/2002 Keegan ..... 136/253
6,489,704 B1 12/2002 Kucherov et al. ..... 310/306
6,531,703 B1 3/2003 Tavkhelidze ..... 250/493.1
2002/0084121 A1 7/2002 Hulen ..... 180/65.3

* cited by examiner

*Primary Examiner*—Hoang Nguyen
(74) *Attorney, Agent, or Firm*—Jimmy L. Funke

(57) ABSTRACT

An apparatus and method for generating power, the apparatus, comprising: a steam engine for providing a first source of power, the steam engine also producing heat waste; a thermionic device for providing a second source of power, the thermionic device providing the second source of power from the heat waste which is provided to the thermionic device, the heat waste of the steam engine being in fluid communication with a heat exchanger of the thermionic device.

23 Claims, 2 Drawing Sheets

APPARATUS AND METHOD FOR STEAM ENGINE AND THERMIONIC EMISSION BASED POWER GENERATION SYSTEM

CROSS REFERENCE TO RELATED APPLICATIONS

This application claims the benefit of U.S. provisional application Ser. No. 60/512,828 filed Oct. 20, 2003, the contents of which are incorporated herein by reference thereto.

TECHNICAL FIELD

This application relates to a method and apparatus for providing a steam engine and thermionic based power generation system. More particularly, a steam engine and thermionic based power generation system wherein the steam engine provides a heat source to the thermionic power generation system.

BACKGROUND

Steam engines have been used to provide mechanical power. In general, such a system burns a combustible fuel wherein water is heated to provide a source of steam and the steam is used to drive a mechanical device to provide a desired output. Examples of early steam engines that were used extensively are steam locomotives and steam powered ships. Steam engines are still in use today although their efficiency has increased greatly. However, regardless of the design of the steam engine employed, the engine still provides a high-grade waste heat on the order of 500 to 1,000 degrees Celsius or higher.

Accordingly, it is desirable to utilize this high-grade waste heat when a steam engine is utilized in a power generating system.

SUMMARY

An apparatus and method for generating power, the apparatus, comprising: a steam engine for providing a first source of power, the steam engine also producing heat waste; a thermionic device for providing a second source of power from the heat waste which is provided to the thermionic device wherein the heat waste of the steam engine is in fluid communication with a heat exchanger of the thermionic device.

A method for generating power, comprising: generating power from a steam engine, the steam engine generating heat exhaust from a first heat exchanger, the first heat exchanger receiving heat from a combustor to heat water into steam to drive a steam turbine; and generating power from a thermionic device, the thermionic device generating power from the heat exhaust received from the first combustor, wherein the heat exhaust is routed to the thermionic device after heating water supplied to the first heat exchanger and the thermionic device generates power without increasing the amount of fuel necessary to heat the water into steam to drive the steam turbine.

DETAILED DESCRIPTION OF EXEMPLARY EMBODIMENTS

Figure 1:
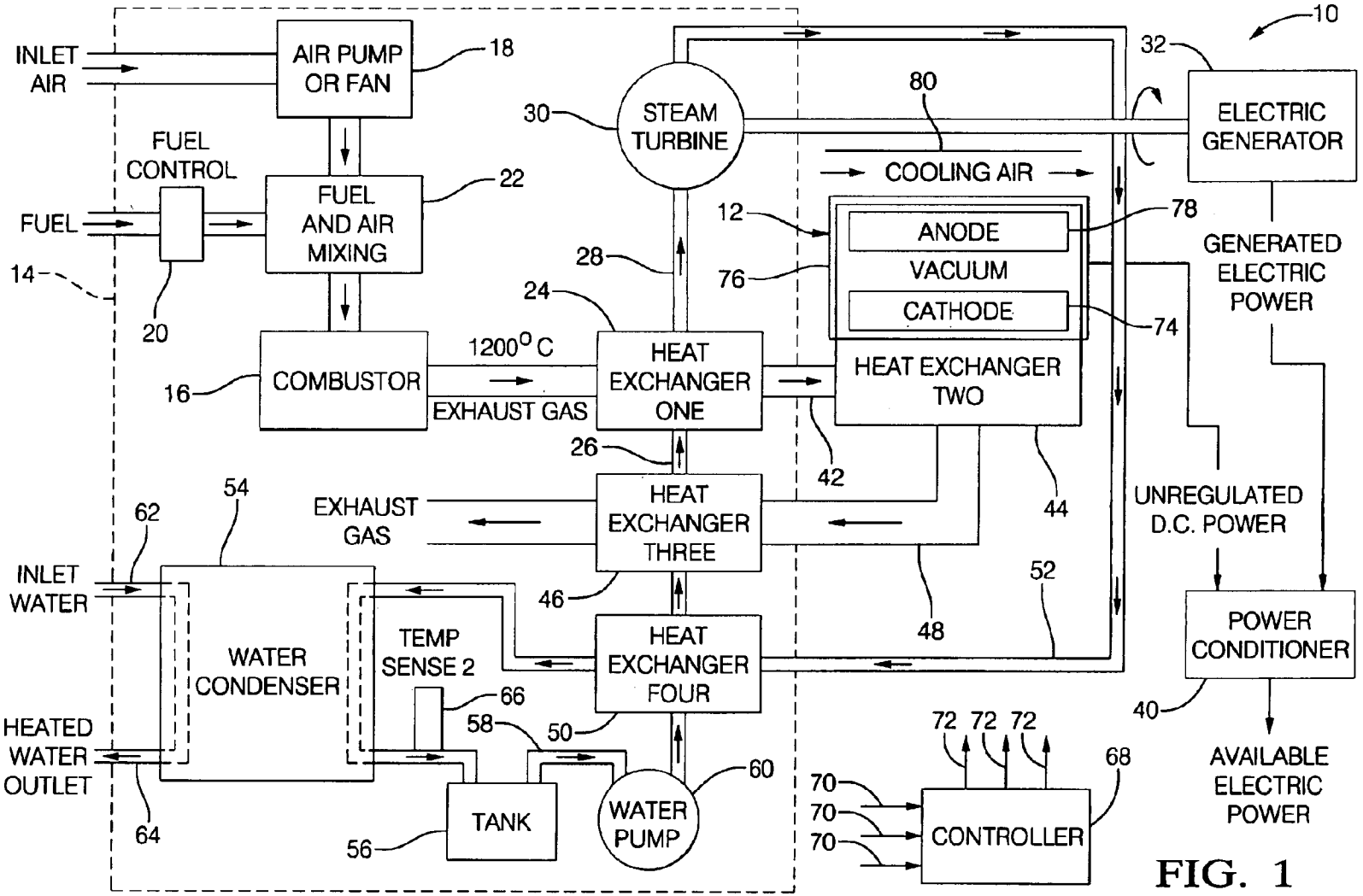
FIG. 1 is a schematic illustration of a dual power generating system of an exemplary embodiment of the present invention.

Disclosed herein is an apparatus, method and system that combines two power systems wherein the waste by product of one system is used to generate power in the other system thereby providing two power sources from one fuel supply. Moreover, the additional or second power source requires no additional fuel other than is necessary to operate the first power source from the one fuel supply.

One power system is a steam engine that is used for generating heat and electric power and the other power system is a thermionic device which converts the heat waste of the steam engine into electric power.

A steam engine turbine is just one method of converting steam power to mechanical power. A steam turbine used in a steam engine requires a source of high-pressure steam delivered by either a boiler or a heat recovery steam generator. A steam engine using a steam turbine consists of three major components: a heat source, a steam turbine and a heat sink. Typically a boiler is used to provide the heat source. The boiler will have a combustor that can burn any type of fuel and/or certain combinations of fuels. During this combustion the boiler will produce superheated steam by heating a supply of water to create high pressure steam wherein the high pressure steam is used to drive a turbine or other mechanical device to provide a desired output. In such an arrangement the heat exhaust of a combustor can reach and exceed 1,000 degrees Celsius.

A thermionic device is capable of generating electric power through thermionic field emission. The thermionic or field emission device produces a stream of high-energy electrons from arrays of cathode tips that are allowed to tunnel through potential barriers using an electric field. In order to create the high-energy electrons in the cathode a thermal source is required to be applied to the cathode thereby exciting the electrons from the same. Recent technological advances have produced thermionic devices wherein an electrical output can be generated with a thermal source on the order of 700 degrees Celsius. Of course, it is contemplated that exemplary embodiments of the present invention may employ thermionic devices that can generate electrical power with heat sources greater or less than 700 degrees Celsius.

As is known in the related arts thermionic energy conversion involves a process wherein electrons are thermionically emitted from a surface by introducing heat sufficient to cause some electrons of the surface to overcome retarding forces at the surface in order to escape. The energy conversion of a thermionic device is illustrated schematically in FIG. 2.

A thermionic energy converter comprises a first electrode or cathode connected to a heat source or heat exchanger, a second electrode or anode connected to a heat sink and separated from the first electrode by an intervening space and leads connecting the electrodes to the electric load, and an enclosure. The space in the enclosure is either highly evacuated or filled with a suitable rarefied vapor, such as cesium. Alternatively, the thermionic device has a semiconductor material at the anode and cathode with a physical junction between the anode and cathode instead of a vacuum.

Referring now to FIG. 1 a steam engine and thermionic emission based power system 10 is illustrated. As illustrated in FIG. 1, a field emission converter or thermionic device 12 is combined with a steam engine 14 in order to produce more electric power with the same amount of fuel (e.g., fuel required to operate the steam engine for producing high pressure steam to drive the turbine). Steam engine 14 comprises a combustor 16, which receives a mixture of fuel and air. The steam engine is illustrated schematically by boxes 18, 20 and 22. The fuel and air are in fluid communication with a mixing device (box 22) wherein mixed fuel and air is provided to combustor 16 for combustion therein. Combustor 16 provides an exhaust gas in excess of 1,200 degrees Celsius. Of course, and depending upon the configuration of the combustor the heated exhaust may be greater or less than 1,200 degrees Celsius. The heated exhaust gas of combustor 16 is provided to a first heat exchanger 24 via a conduit or other path that provides fluid communication between combustor 16 and heat exchanger 24. Heat exchanger 24 also receives an inlet of water from conduit 26 and after heating by heat exchanger 24 provides an output of high pressure steam via conduit 28 to a steam turbine 30.

Different types of steam engines exist, accordingly it is noted that the systems disclosed herein can operate with different configurations. Therefore, reference to a particular configuration and components of a steam engine for use with a thermionic device are provided as examples and the present invention is not intended to be limited by the same.

Generally, the system may comprise at least one steam engine, at least one thermionic device, one or more heat exchangers, and a power conditioner for providing power to either or both an electric storage medium or a multiplicity of electrical loads. If the loads and the power sources are compatible, the power conditioner may not be required. Thus, the power conditioner is optional.

During operation the steam engine can be operated at high adiabatic temperatures, e.g. up to about 1,200° C. Typically at least one heat exchanger is employed to cool the steam engine effluent. However, and in accordance with exemplary embodiments of the present invention the heat exchanger is configured to provide a source of heat to a thermionic device.

The steam engine may in one embodiment be used in conjunction with an engine, for example, to produce power to a vehicle. As discussed, herein the term "engine" is meant in the broad sense to include all combustors which combust hydrocarbon fuels, such as internal combustion engines, diesel engines, stirling engines, etc.

As illustrated in FIG. 1, the heated exhaust of the steam engine is provided to the thermionic device 12 via a conduit, which provides fluid communication between the first heat exchanger of the steam engine 14 and thermionic field device 12.

The steam turbine is mechanically coupled to an electric generator 32 wherein the steam turbine is drive by the steam and the steam turbine drives electric generator 32 to produce generated electric power to a power conditioner 40. Power conditioner 40 is configured to provide conditioned power (AC or DC) to an electrical load.

Thermionic device 12 of power system 10 is configured to receive the heat waste of first heat exchanger 24 via a conduit 42 or alternatively a direct connection between first heat exchanger 24 and thermionic device 12. Thus, after first heat exchanger 24 produces steam for steam turbine 30 the heat waste or heat exhaust after heating the water to generate steam is provided to the thermionic device. More particularly, the heat waste is provided to a second heat exchanger 44. Second heat exchanger 44 comprises a portion of thermionic device 12 and is configured to receive the waste heat of first heat exchanger 24. In an exemplary embodiment second heat exchanger 44 is configured to provide the necessary heat to cause thermionic device 12 to generate power. This is facilitated by a design wherein the heat exhaust of first heat exchanger 24 after heating the water to produce steam for driving the steam turbine is about 500 to 1000 degrees Celsius, a temperature that is sufficient to cause electrons to emit from a cathode of thermionic device 12.

In addition, second heat exchanger 44 is also fluidly coupled to a third heat exchanger 46 via a conduit 48. Conduit 48 allows the heat exhaust of second heat exchanger 44 to be routed to the third heat exchanger after the heat waste of the first heat exchanger is used for power generation in thermionic device 12. The exhaust (steam and heat) of steam turbine is also provided to a fourth heat exchanger 50 via a conduit 52. As indicated by the directional arrows in FIG. 1 this exhaust is provided to the fourth heat exchanger which is also fluidly connected in series with third heat exchanger 46 and first heat exchanger 24 wherein each of the aforementioned heat exchangers provides some heat to a supply of water before it is heated into steam and by first heat exchanger 24 and the steam is provided to the steam turbine via conduit 28.

Additionally, the exhaust of fourth heat exchanger 50 is provided to a water condenser 54 via a conduit 56 wherein the remaining exhaust (steam and heat) is condensed and the water is collected and supplied to a holding tank 56 via a conduit 58. A fluid pump 60 is in fluid communication with tank 56 and conduit 58 and pump 60 is configured to provide water to fourth heat exchanger 50, third heat exchange 46 and ultimately first heat exchanger 24 via a water supply line in order to provide steam to steam turbine 30 by heating the water until it transforms into steam. It is noted that the location of each of these heat exchangers allows the heat waste to be used in different processing steps thus, the water is preheated before it reaches first heat exchanger 24 allowing for most economical use of the heat waste of the system.

Water condenser 54 also has a water inlet 62 and a water outlet 64 wherein a separate supply of water may be heated via the steam exhaust supplied to water condenser 54. Also located in the system between water condenser 54 and tank 56 is a temperature sensor 66 for monitoring the temperature of the water as it is provided to the tank. Temperature sensor 66 will provide a signal to a controller 68. In an exemplary embodiment controller 68 comprises a microprocessor configured to receive a plurality of input signals 70 (e.g., signal for temperature sensor 66 or other devices) in order to produce a plurality of output signals 72 for operating the various components of system 10.

An exemplary example is that the controller may vary the fuel supply to combustor 16 as the temperature of the water supply to first heat exchanger 24 increases from continued operation and additional heating of the water may not be required since the first, second, third and fourth heat exchangers each provide heat to the water. In other words the system may require more fuel at initial start up (e.g., water in tank is cool) and as the system operates and the thermal energy of the heat exchanger is used by the various heat exchangers of the system the temperature of the water supply may increase. Other components of the power supply that are controlled by the controller include but are not limited to the following: air intake pump or fan 18, fuel and air mixing device 22, fuel supply control device 20, combustor 16, water pump 60, steam turbine 30, electric generator 32, power conditioner 40 and any of a plurality of valves disposed throughout the power supply or in the conduits interconnecting the various heat exchangers in order to control the flow of fluids therein. For example, fluid movement between each of the heat exchangers may be limited until the fluid has reached an acceptable temperature level for transference onto the next component in the system.

As illustrated the exhaust gases emitting from the first heat exchanger are used to provide the thermal input required to start the emission of electrons from the cathode of the thermionic device. In order to provide the exhaust gases to the thermionic device, the device is positioned at an appropriate location in the exhaust stream of the steam engine in order to produce a high temperature differential across the thermionic device. This will allow the thermionic device to produce electrical power. Accordingly, the system is capable of producing more electrical power by combining the electrical output of the steam unit and the thermionic device.

Figure 2:
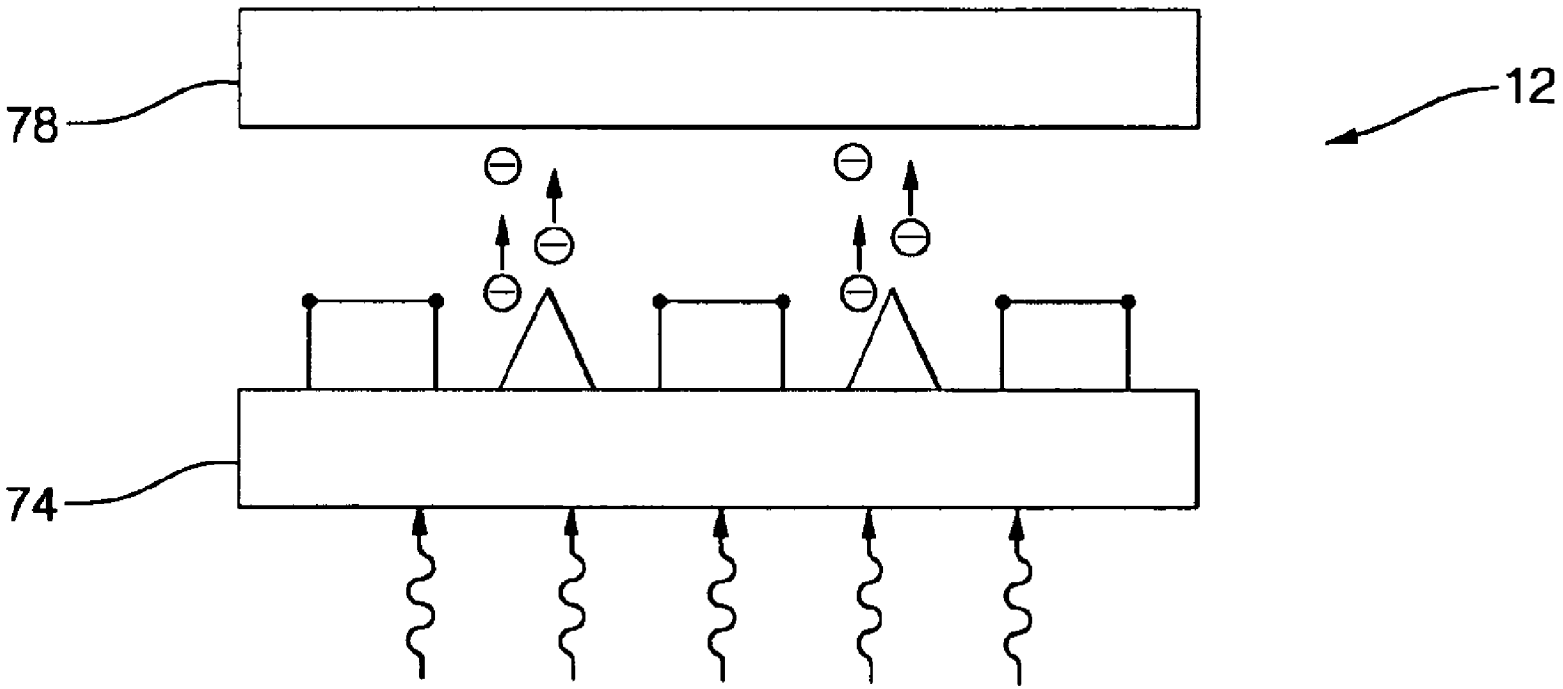
FIG. 2 is a schematic illustration of a thermionic energy conversion device.

In accordance with an exemplary embodiment and referring now to FIGS. 1 and 2 the thermionic field device is a device which can convert the heat energy or exhaust of the first heat exchanger into electric energy by thermionic emission without any additional heating of the exhaust of the first heat exchanger.

When a heat source supplies heat at a high enough temperature to one electrode, electrons are thermionically injected or tunnel into the evacuated or rarefied-vapor-filled interelectrode space or alternatively a semiconductor material. The electrons move toward the other electrode, the collector, which is kept at a low temperature near that of the heat source or heat sink. There the electrons collect and return to the hot electrode via external electric leads and an electric load or battery connected between the emitter and the collector. Thus, it is contemplated that an exemplary embodiment of the present invention will employ a thermionic device which is capable of providing power from the waste heat of the steam engine.

In accordance with an exemplary embodiment, system 10 is contemplated for use with a thermionic device which can produce power when the heat exhaust of the steam engine is provided to the cathode or emitter of the device. An exemplary temperature of the heated exhaust of the first heat exchanger is up to 1,000° C. with an optimum operating temperature of about 700° C.

One such example of a thermionic device is found in U.S. Pat. Nos. 6,396,191 and 6,489,704 the contents of which are incorporated herein by reference thereto. Of course, any thermionic device capable of providing an electrical output from the operating temperature of the first heat exchanger is contemplated to be used with exemplary embodiments of the present invention.

Accordingly, and as illustrated in FIG. 1, the thermionic device is configured for use with first heat exchanger 24. The heat exchanger is configured and positioned to receive heated exhaust from the combustor. First heat exchanger 24 provides heat energy to a cathode or emitter 74. Emitter or cathode 74 is received within a housing 76 and is in a facing spaced relationship with regard to an anode or collector 78 which receives the electrons as they pass through a vacuum or other material disposed between emitter 74 and collector 78. Collector 78 is also received within housing 76. A circuit is provided between the emitter and collector for providing a source of power to power conditioner 40. In an exemplary embodiment power conditioner regulates the power provided by the electric generator and the thermionic device. In addition, and as an alternative, power conditioner is a DC/AC inverter, or alternatively no conditioner is required.

In order to provide additional efficiency, the heat exhaust from the second heat exchanger and the steam turbine can be recirculated back into the system.

It is also noted that if the system is starting up from a non-power generating state (e.g., water cool and combustor off) it may take a period of time for the water to be heated into steam to generate electrical power. However, since the thermionic device is in fluid communication with the exhaust of the first heat exchanger the thermionic device may be in a power generating mode before the steam turbine. Thus, the thermionic device may be able to provide power immediately upon request through the use of first heat exchanger 24 and combustor 16. This operation will eliminate the need for an electric storage medium which is typically used to provide a source of power in systems requiring a start up time period. During the startup time period, the electrical power is used for running the controller, control actuators, and other electricity-consuming devices in the steam engine system. In an exemplary embodiment, a controller is configured to monitor the system and provide such a power generating configuration.

In another alternative exemplary embodiment the thermionic device is in direct thermally contact with the first heat exchanger or alternatively the combustor.

Although the various embodiments disclosed herein discuss and illustrate certain numbers of steam engines and thermionic devices it is, of course, contemplated that multiple devices (e.g., steam engines, thermionic devices, combustors, etc.) may be employed in various embodiments of the present invention.

In any of the embodiments discussed herein a controller or control module 68 is provided to operate the various components of the systems of exemplary embodiments of the present invention. The controller comprises among other elements a microprocessor for receiving signals 70 indicative of the system performance as well as providing signals 72 for control of various system components. The controller will also comprise read only memory and programmable memory in the form of an electronic storage medium for executable programs or algorithms and calibration values or constants, random access memory and data buses for allowing the necessary communications (e.g., input, output and within the controller) with the controller in accordance with known technologies.

The controller receives various signals from various sensors in order to determine various operating schemes of the disclosed system for example, whether the steam engine is warmed up and operating at a predetermined state wherein the desired heat exhaust is obtainable for the thermionic device. In addition, the controller will also operate the combustor in response to the operational status and needs of the system. Furthermore, the controller is capable of controlling the air intake into any of the devices discussed herein and is also capable of operating the fuel pump and the water pump.

In accordance with operating programs, algorithms, look up tables and constants resident upon the microcomputer of the controller various output signals are provided by the controller. These signals can be used to vary the operation of the steam engine, the thermionic device and the combustor.

In FIG. 1, a cooling medium or device 80 for providing a cooling medium is shown as air flowing across the anode of the thermionic device. It is of course understood that other cooling mediums may be used to cool the anode of the device. Such cooling mediums include but are not limited to the following: water, coolant mixtures or any other substances to maintain the anode surface at a low enough temperature to permit electric power generation by the field emission or thermionic device. The cathode of the thermionic device can be placed in the system where the surface temperature is hot enough to perform thermoelectric power generation.

Accordingly, the exhaust from first heat exchanger of the steam engine is used to provide the required thermal power for the thermionic device, thus eliminating the need for a thermal source for the thermionic device. Moreover, use of the waste heat exhaust from the solid steam unit thus, reducing the total fuel intake and depending on the size of the unit (steam or thermionic device) eliminate the need for a separate thermal source for the thermionic converter.

In addition, mechanical integration of the steam engine and the thermionic device allows exemplary embodiments of the present invention to obtain higher power output with the same amount of fuel, which results in a higher electric to fuel efficiency that can be obtained from other individual units. Also, electrical integration of the thermionic converter and the steam engine unit results in higher electrical output.

The steam engine and thermionic emission system 10 comprises a steam engine 14 and a thermionic field emission device 12 each being configured to provide DC power to a power conditioner 40, which, if necessary converts the unregulated DC power of the steam engine and the thermionic field emission device to regulated DC power.

While the invention has been described with reference to one or more exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A power supply, comprising:

a steam engine for providing a first source of power, said steam engine comprising: a combustor, a first heat exchanger configured to receive a heat exhaust of said combustor, said first heat exchanger using said heat exhaust to convert a supply of water into steam, wherein the steam generated by the steam engine is used to drive a turbine of the power supply and said steam engine also producing heat waste;

a thermionic device for providing a second source of power, said thermionic device providing said second source of power from said heat waste, wherein said heat waste of said steam engine is provided to a second heat exchanger of said thermionic device by an exhaust conduit, said exhaust conduit providing fluid communication between said first heat exchanger and said second heat exchanger; and a third heat exchanger, said third heat exchanger being configured to receive an exhaust of said second heat exchanger, wherein said exhaust of said second heat exchanger is used to preheat a supply of water before it reaches said first heat exchanger.

2. The power supply as in claim 1, further comprising: a fourth heat exchanger, said fourth heat exchanger being configured to receive an exhaust of said turbine, wherein said exhaust of said turbine is used to preheat a supply of water before it reaches said second heat exchanger.

3. The power supply as in claim 2, wherein said exhaust of said turbine comprises steam.

4. The power supply as in claim 3, further comprising:

a water condenser configured to receive an exhaust of said fourth heat exchanger and said water condenser supplies condensed water from said exhaust of said fourth heat exchanger into a tank; and a pump configured to pump water from said tank into said fourth heat exchanger, said third heat exchanger and said first heat exchanger.

5. The power supply as in claim 4, wherein said first heat exchanger, said third heat exchanger and said fourth heat exchanger are connected in series for providing said supply of water.

6. The power supply as in claim 5, further comprising:

a temperature sensor for providing a signal indicative of the temperature of the water being supplied to said tank; and a controller configured to receive said signal as well as other signals indicative of the operational status of components of the power supply, wherein said controller provides a plurality of output signals for controlling the operational status of components of the power supply.

7. The power supply as in claim 1, wherein said heat waste is generated by said steam engine before, during, and after said steam engine is providing said first source of power.

8. The power supply as in claim 1, wherein said second heat exchanger is configured to provide heat to a cathode of said thermionic device.

9. The power supply as in claim 8, wherein said cathode is located in a housing of said thermionic device and said cathode is separated from an anode of said thermionic device, wherein said heat provided to said cathode causes electrons to separate from said cathode.

10. The power supply as in claim 9, wherein a vacuum is disposed between said anode and said cathode.

11. The power supply as in claim 8, wherein said thermionic device is configured to provide power when a heat source of approximately 1000 degrees Celsius is provided to said cathode.

12. The power supply as in claim 11, wherein said power supply is configured for use in stationary power plant.

13. The power supply as in claim 11, wherein said power supply is an auxiliary power unit configured for use in a vehicle.

14. The power supply as in claim 11, further comprising a power conditioner for receiving and conditioning power generated by said steam engine and said thermionic device.

15. The power supply as in claim 1, wherein a plurality of steam engines provide heat waste to a plurality of thermionic devices.

16. The power supply as in claim 1, further comprising another heat exchanger, said another heat exchanger providing an inlet and an exhaust of a cooling medium to an anode of said thermionic device, wherein unheated air is supplied to said inlet and air heated by said anode is supplied to said exhaust, said anode being maintained at a temperature differential between a cathode of said thermionic device.

17. The power supply as in claim 16, wherein said another heat exchanger also provides an exhaust to an inlet conduit of said steam engine.

18. The power supply as in claim 1, where said heat waste of said steam engine is within a range defined by a lower limit of 500 degrees Celsius and an upper limit of 1,400 degrees Celsius when said steam engine is providing said first source of power.

19. A power supply, comprising:

a steam engine for providing a first source of power, said steam engine producing heat waste when said steam engine is providing said first source of power, said steam engine comprising:

a combustor for providing a source of heat to a first heat exchanger of said steam engine;

an exhaust conduit providing fluid communication between an exhaust of said first heat exchanger and a second heat exchanger, said second heat exchanger being configured to provide heat to a thermionic device, said thermionic device providing a second source of power from the heat provided by said second heat exchanger; and a third heat exchanger, said third heat exchanger being configured to receive an exhaust of said second heat exchanger, wherein said exhaust of said second heat exchanger is used to preheat a supply of water before it reaches said first heat exchanger.

20. The power supply as in claim 19, where said heat waste of said steam engine is within a range defined by a lower limit of 500 degrees Celsius and an upper limit of 1,400 degrees Celsius when said steam engine is providing said first source of power.

21. The power supply as in claim 19, further comprising another heat exchanger, said another heat exchanger providing an inlet and an exhaust of air to an anode of said thermionic device, wherein unheated air is supplied to said inlet and air heated by said anode is supplied to said exhaust, wherein said anode is maintained at a temperature differential between a cathode of said thermionic device.

22. The power supply as in claim 19, wherein said thermionic device provides an initial source of power during a warm up phase of said steam engine.

23. A method for generating power, comprising:

generating power from a steam engine, said steam engine generating heat exhaust from a first heat exchanger, said first heat exchanger receiving heat from a combustor to heat water into steam to drive a steam turbine;

generating power from a thermionic device, said thermionic device generating power from said heat exhaust received from said first heat exchanger, wherein said heat exhaust is routed to said thermionic device after heating water supplied to said first heat exchanger and said thermionic device generates power without increasing the amount of fuel necessary to heat the water into steam to drive said steam turbine, said thermionic device comprising a second heat exchanger for receiving said heat exhaust; and preheating water supplied to said first heat exchanger by providing a third heat exchanger, said third heat exchanger being configured to receive a heat exhaust of said second heat exchanger and said third heat exchanger is configured to heat water prior to is being supplied to said first heat exchanger.

* * * * *